US005918489A

United States Patent [19]

Yang

[11] Patent Number: 5,918,489

[45] Date of Patent: Jul. 6, 1999

[54] PADLOCK

[76] Inventor: Kuo-Tsung Yang, 2nd Fl., No. 5, Alley 10, Lane 321, Hsinming Rd., Taipei, Taiwan

[21] Appl. No.: 09/003,360

[22] Filed: Jan. 6, 1998

[51] Int. Cl.[6] ..... F05B 37/06

[52] U.S. Cl. ..... 70/28; 70/52; 70/312

[58] Field of Search ..... 70/28, 22, 27, 70/29, 41, 45–47, 299, 306, 312, 53, 52

[56] References Cited

U.S. PATENT DOCUMENTS

| | | | |
|---|---|---|---|
| 347,618 | 8/1886 | Knowles | 70/28 |
| 1,168,884 | 1/1916 | Héé | 70/27 |
| 4,803,856 | 2/1989 | Ling | 70/28 |
| 4,860,561 | 8/1989 | Hwang | 70/28 |
| 4,866,959 | 9/1989 | Ling | 70/312 |
| 5,042,277 | 8/1991 | Jenn-Rong | 70/28 |
| 5,359,867 | 11/1994 | Ling et al. | 70/28 |
| 5,524,462 | 6/1996 | Loughlin | 70/41 |
| 5,557,954 | 9/1996 | Ling | 70/312 |
| 5,685,179 | 11/1997 | Yang | 70/28 |
| 5,689,979 | 11/1997 | Yu | 70/312 |
| 5,765,409 | 6/1998 | Yang | 70/28 |
| 5,782,113 | 7/1998 | Chen | 70/28 |

*Primary Examiner*—Darnell M. Boucher
*Attorney, Agent, or Firm*—Rosenberg, Klein & Bilker

[57] ABSTRACT

A padlock includes a body combined with a first casing a second casing. The first casing has a hook-like latch integrally extending therefrom. A pivotal member is received in the body and has a rod extending from a first end thereof to alignedly contact with the hook-like latch when it is pivoted. A symbol-sequence selecting device is received in the body to cooperate with the pivotal member. The symbol-sequence selecting device is operable at two sides of the padlock. The padlock further includes a release member movably mounted to a surface of the first casing to activate a pivoting of the pivotal member.

8 Claims, 6 Drawing Sheets

PADLOCK

BACKGROUND OF THE INVENTION

1. Field of the Invention

The present invention relates to a padlock, and more particularly to a padlock which has a release member mounted to a surface thereof and a symbol-sequence selecting means arranged at two sides thereof to facilitate operation.

2. Description of Related Art

A conventional padlock typically has a structure as shown in FIGS. 8 and 9. The padlock includes a casing 80. A hook-like latch 81 extends from one side of the casing 80 and a retaining rod 82 extends from the other side of the casing 80 to align with a distal tip of the latch 81. The padlock further includes plural number-wheels 83 arranged within the casing 80 and a push key 84 mounted to one side face of the casing 80. When the number-wheels 83 are selected to a correct number series, the push key 84 is allowed to drive the retaining rod 82 to shift, as shown in FIG. 10, whereby the hook-like latch 81 can extend through the object which is to be locked. When the push key 84 is released and the retaining rod 82 is returned to its initial position and the number-wheels 83 are reset to a random number series, thereby securing the object.

This conventional padlock has a disadvantage that it is inconvenient for the push block 84 to be operated because the push block 84 has to be designed rather small in order to fit one side of the casing 80 which has a small surface area.

The present invention provides an improved padlock to mitigate and/or obviate the aforementioned problems.

SUMMARY OF THE INVENTION

One object of the present invention is to provide a padlock which has a release member mounted to a surface thereof and a symbol-sequence selecting means arranged on two sides thereof to facilitate operation.

Other objects, advantages and novel features of the invention will become more apparent from the following detailed description when taken in conjunction with the accompanying drawings.

DETAILED DESCRIPTION OF PREFERRED EMBODIMENT

Figure 1:
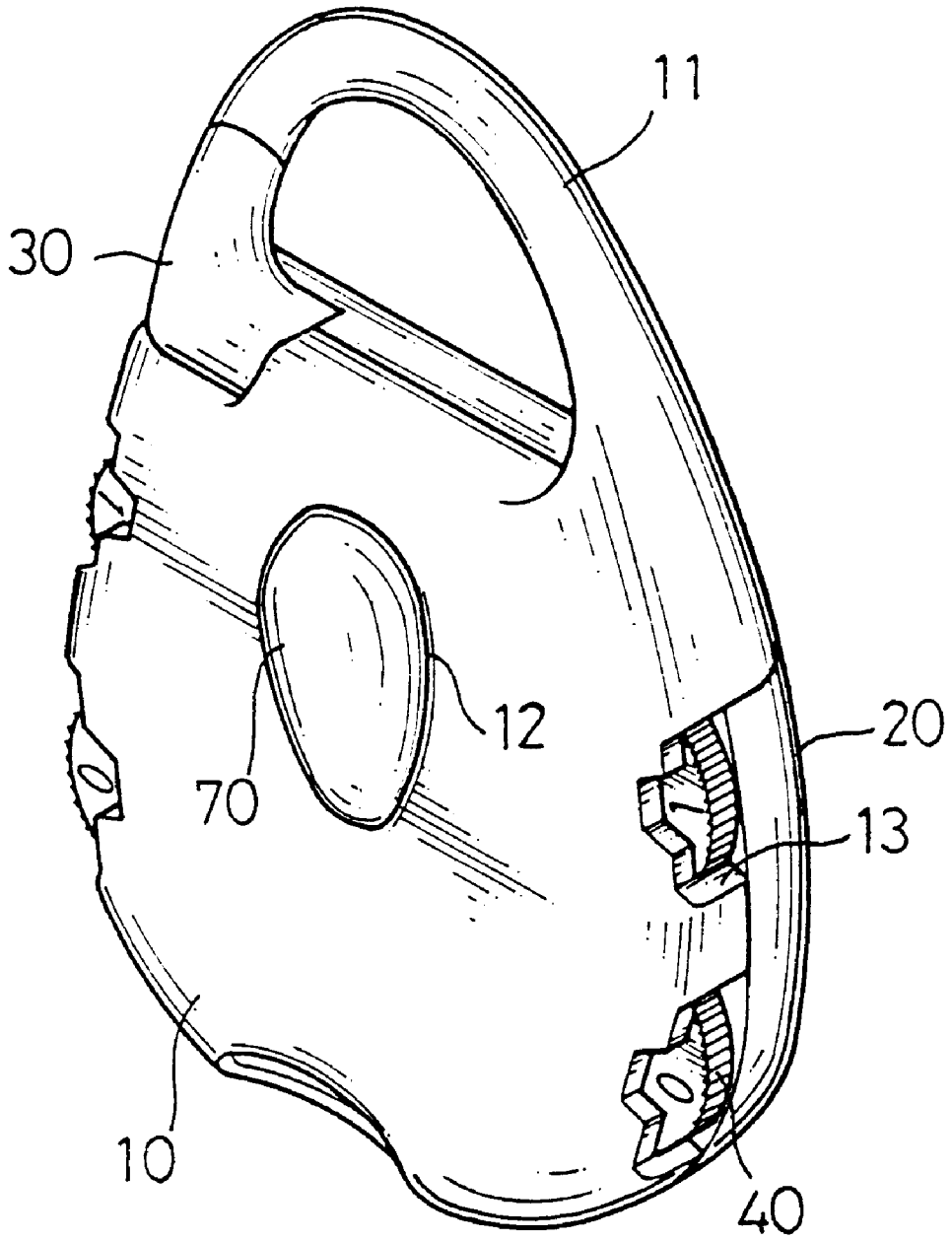
FIG. 1 is a perspective view showing a padlock constructed in accordance with the present invention.

Referring to FIG. 1, a padlock constructed in accordance with the present invention comprises a body (not numbered) combined with a first casing 10 and a second casing 20, a pivotal member 30 received in the body, a symbol-sequence selecting means 40 received in the body to cooperate with the pivotal member 30, and a release member 70 movably mounted to a surface of the first casing 10 to activate a pivoting of the pivotal member 30. The detailed description of the padlock with the above-mentioned construction will be made hereinafter.

Figure 2:
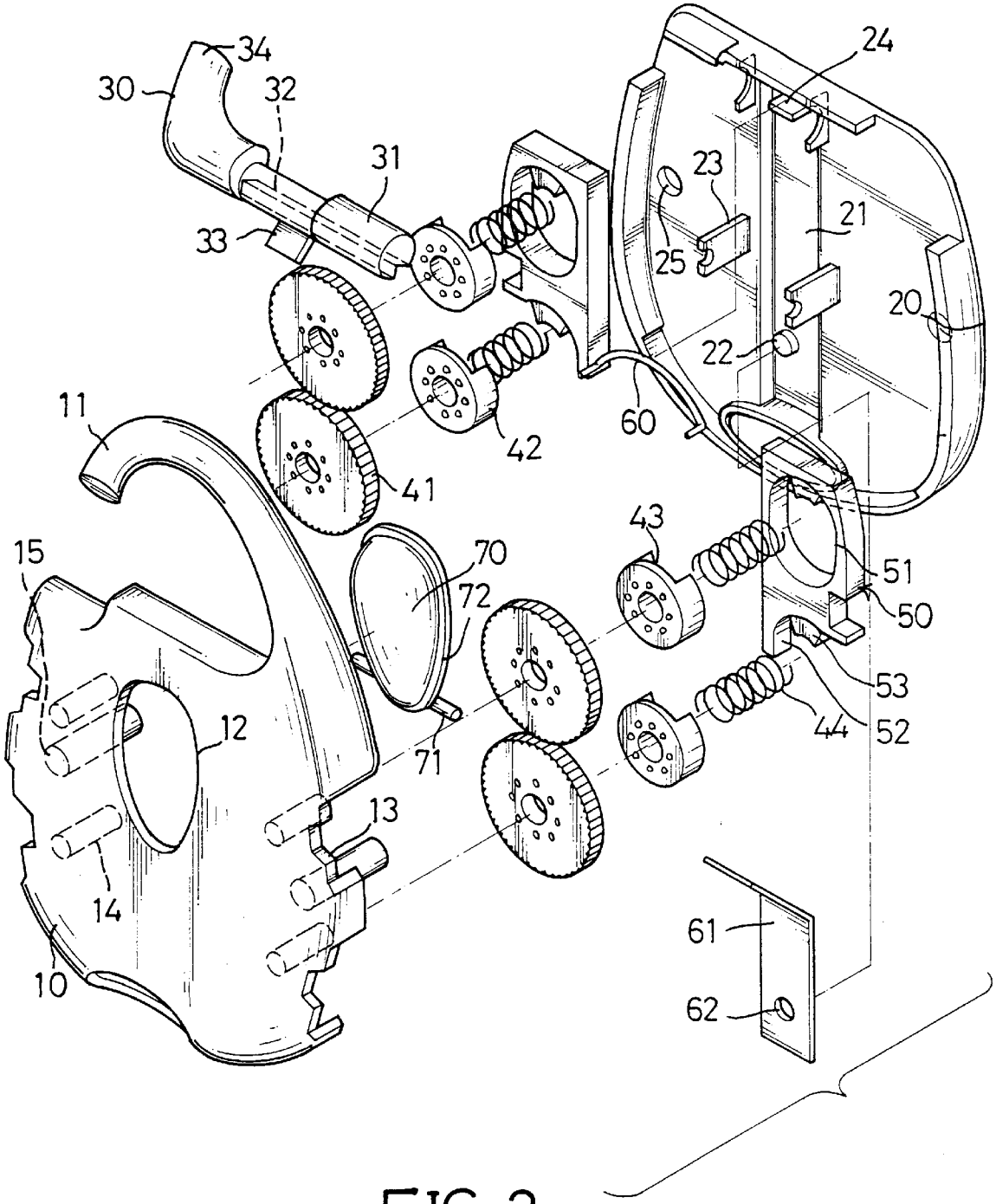
FIG. 2 is an exploded perspective view showing the elements of the padlock of the present invention.

Referring to FIG. 2, the first casing 10 of the body has a hook-like latch 11 integrally extending from an upper portion thereof. A through hole 12 is defined in a surface of the first casing 10 for the release member 70 to be movably received therein and a plurality of notches 13 are respectively defined at two sides of the first casing 10 from each of which a part of the symbol-sequence selecting means 40 projects for a user to operate. The first casing 10 further includes a plurality of bosses 14 and a pair of posts 15 extending from an inner face thereof.

The second casing 20 is configured to mate with the first casing 10 and defines a pair of apertures 25 corresponding to the pair of posts 15 of the first casing 10, such that the pair of posts 15 can be respectively inserted into the pair of apertures 25 and then tips thereof are deformed to engage the first casing 10 with the second casing 20. The second casing 20 further defines a longitudinal trough 21 in an inner face thereof which has a knob 22 formed therein, a pair of shaft supports 23 respectively extending from the inner face thereof and a clip 24 formed on the inner face and near a top end thereof.

The pivotal member 30 is L-shaped and has a transverse spindle 31 and a rod 34 integrally and perpendicularly extending from one end of the transverse spindle 31 to alignedly contact with a distal tip of the hook-like latch 11 of the first casing 10 when the pivotal member 30 is pivoted. The transverse spindle 31 defines an axial recess 32 in a periphery thereof and has a stopper 33 extending from a midway of the periphery thereof.

The symbol-sequence selecting means 40 includes a plurality of wheel means (not numbered) symmetrically arranged adjacent to two sides of the padlock. Each wheel means has a symbol wheel 41, a corresponding control wheel 42 and a spring 44 mounted around a respective one of the bosses 14 of the first casing 10. It is appreciated that the symbols may be numbers, alphabet letters, etc. The symbol wheel 41 and the corresponding control wheel 42 of each wheel means are cooperated with each other by means of a plurality of domes and lugs (not numbered) respectively formed thereon in a conventional manner. In a preferred embodiment of the present invention, there are two pairs of wheel means provided for symbol selection. Each pair of wheel means contains an upper wheel means and a lower wheel means.

Figure 3:
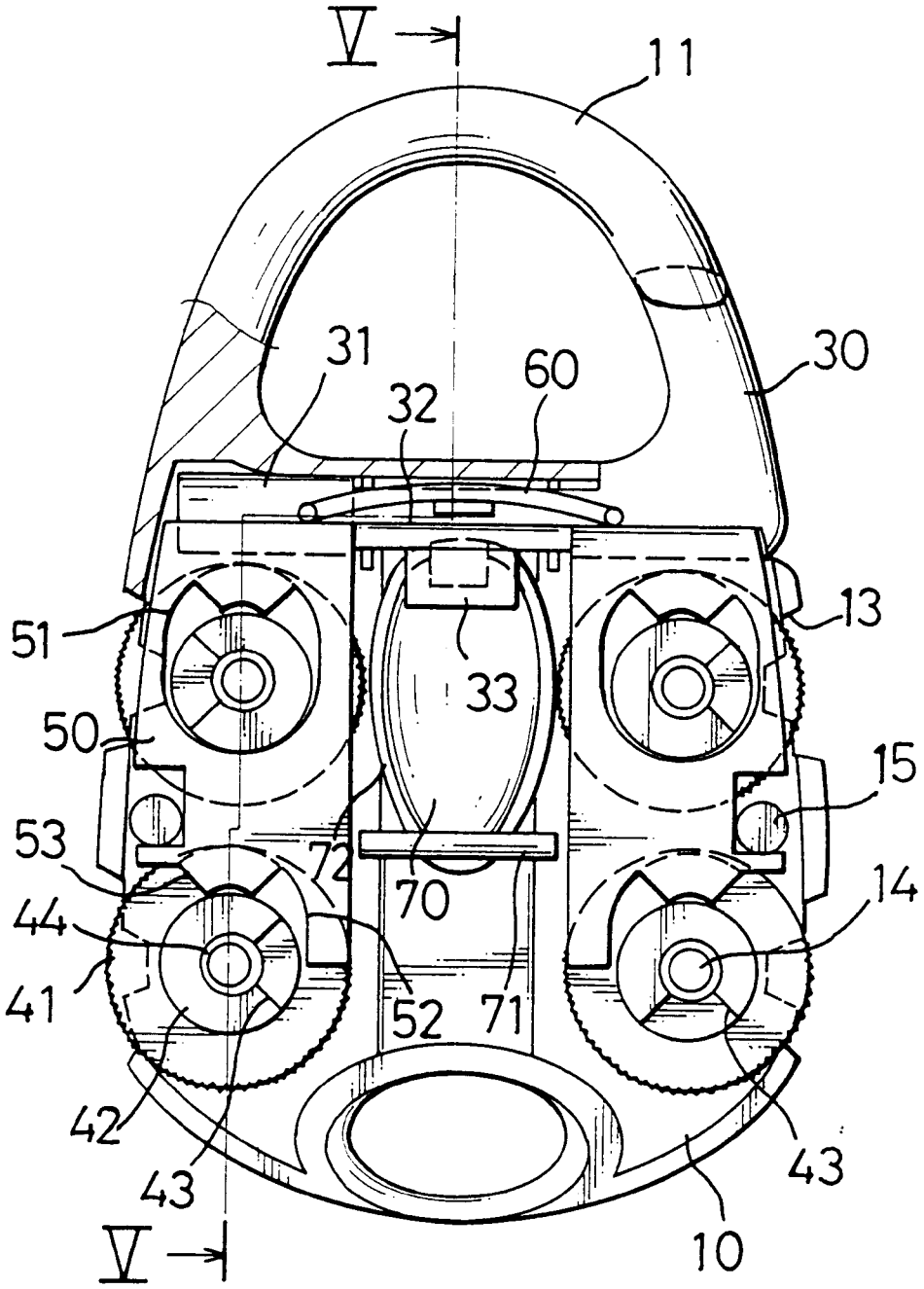
FIG. 3 is a sectional front view showing a combined structure of the padlock of the present invention.

The padlock of this invention further includes a pair of control plates 50 respectively engagingly received in the recess 32 of the pivotal member 30 and cooperated with a pair of wheel means. Each control plate 50 defines an elliptical hole 51 therethrough for movably receiving a respective control wheel 42 of the upper wheel means and an arcuate cutout 52 at a bottom end thereof for movably receiving a corresponding control wheel 42 of the lower wheel means. A pair of integral protrusions 53 respectively extend from a periphery defining each of the elliptical hole 51 and the arcuate cutout 52 to correspond to a gap 43 defined in a periphery of each control wheel 42. In addition, a flexible bar 60 is grippingly received in the clip 24 of the second casing 20. Two ends of the flexible bar 60 respectively abut against a top face of each of the pair of control plates 50 and apply a downward force to the pair of control plates 50, as shown in FIG. 3.

Figure 6:
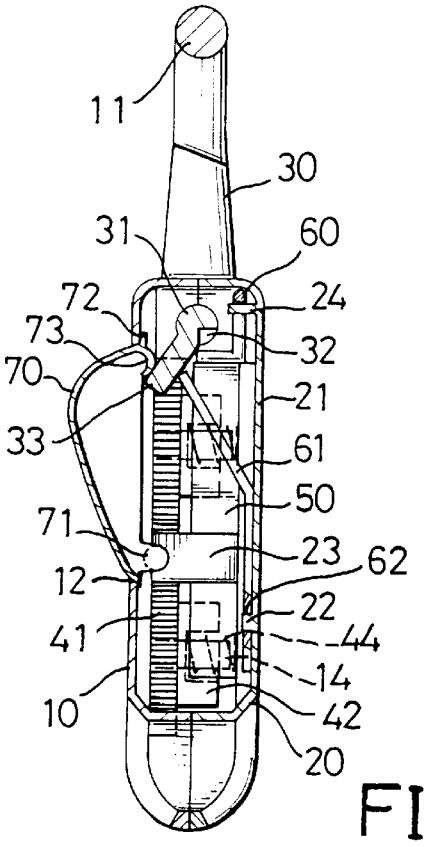
FIG. 6 is a sectional end view showing the padlock taken from line VI—VI of FIG. 4.

The release member 70 is movably received in the through hole 12 of the first casing 10 and is configured as an arcuate plate body (not numbered). The release member 70 has a transverse pivot 71 integrally formed at a lower portion thereof to be secured in the pair of shaft supports 23 and a flange 72 integrally extending from a periphery thereof to abut against a periphery defining the through hole 12, thereby preventing separation of the release member 70 from the through hole 12. Referring to FIG. 6, the release member 70 further includes an arcuate press portion 73 integrally extending inward from a top end of the arcuate plate body to abut against a first side of the stopper 33 of the pivotal member 30. Additionally, an angled resilient strip 61 is arranged in the body of the padlock. The angled resilient strip 61 has a top end abutting a second side of the stopper 33 of the pivotal member 30 and a bottom end with a locating hole 62 engaged with the knob 22 of the trough 21 of the second casing 20.

Figure 5:
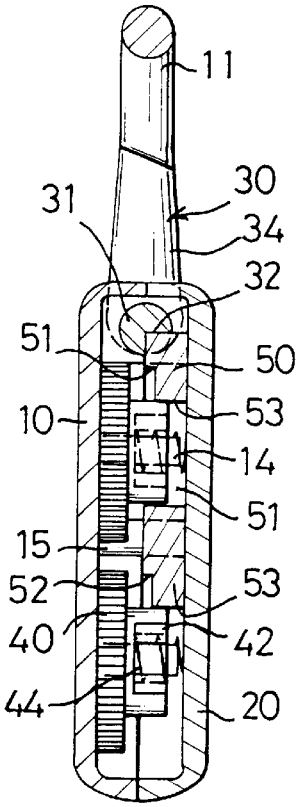
FIG. 5 is a sectional end view showing the padlock taken from line V—V of FIG. 3.
Figure 4:
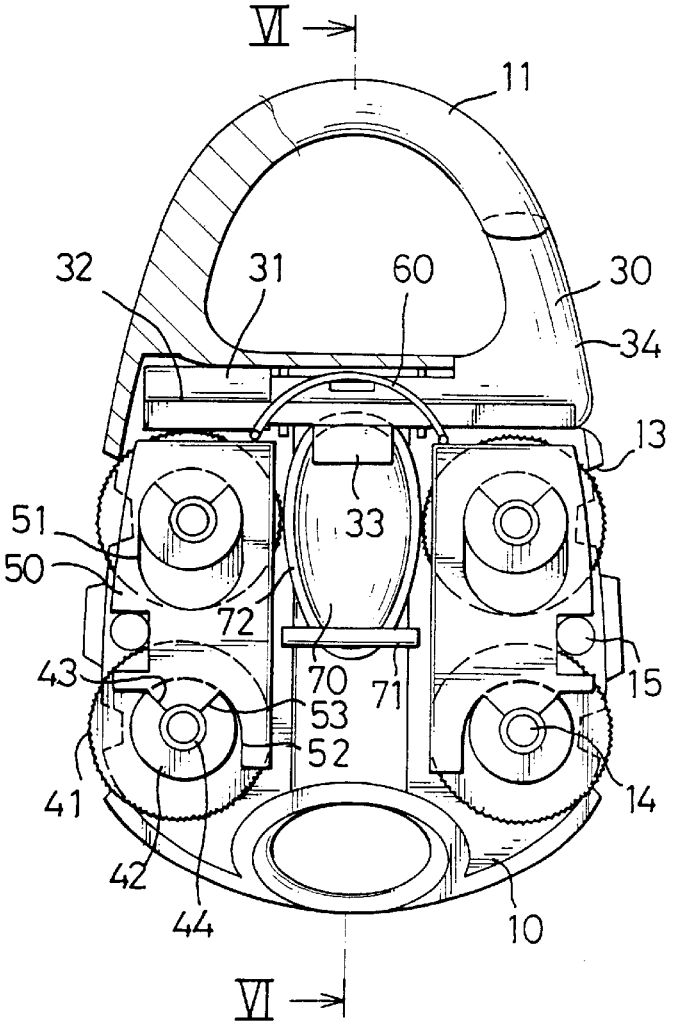
FIG. 4 is a sectional view showing a shifted arrangement of the padlock after a correct number of a symbol-sequence selecting means thereof is selected.
Figure 7:
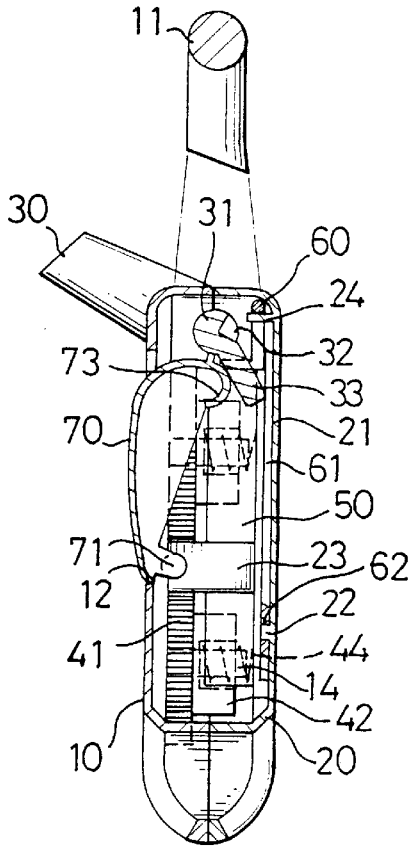
FIG. 7 is a sectional view showing a combined structure of the padlock after a release member thereof is pressed.
Figure 8:
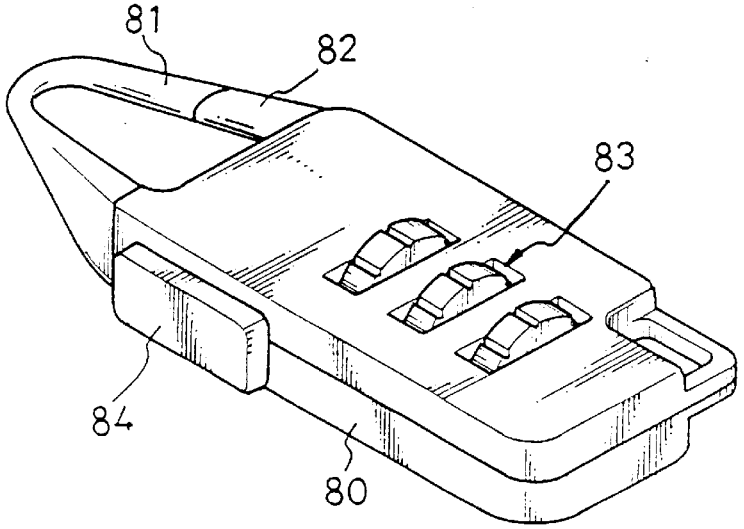
FIG.8 PRIOR ART
FIG. 8 is a perspective view showing a conventional padlock.
Figure 9:
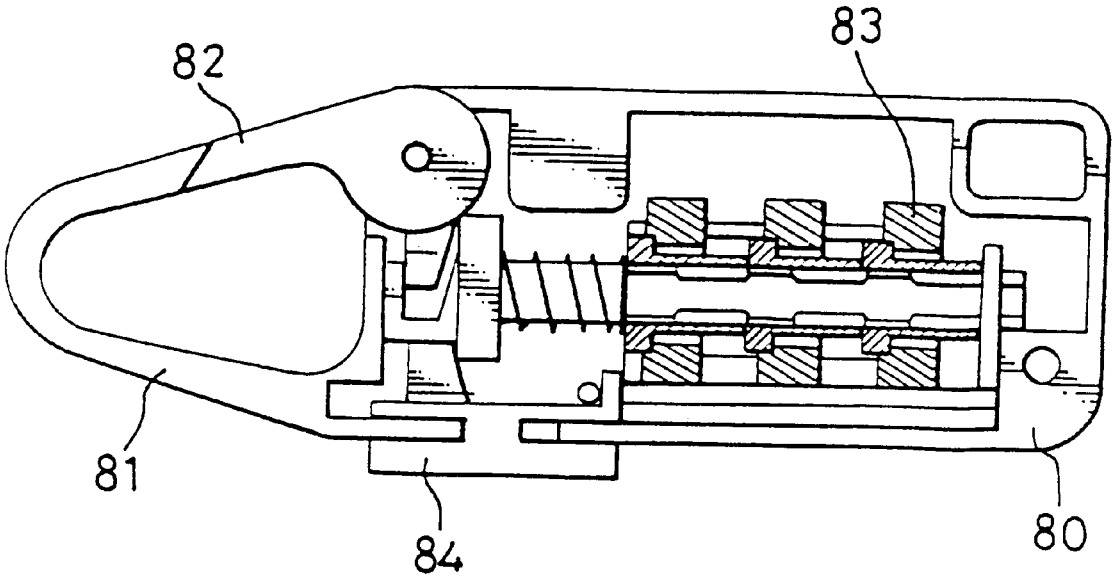
FIG.9 PRIOR ART
FIG. 9 is a schematic view showing a locked state of the conventional padlock of FIG. 8.
Figure 10:
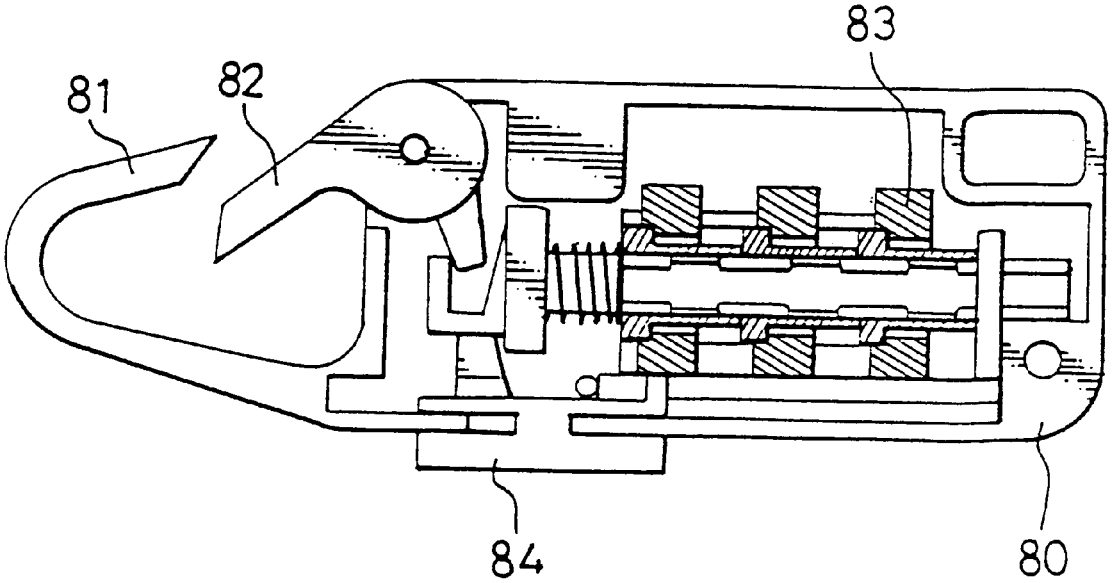
FIG.10 PRIOR ART
FIG. 10 is a schematic view showing an unlocked state of the conventional padlock of FIG. 8.

As illustrated in FIG. 5, each of the pair of control plates 50 has a top end engagingly received in the recess 32 of the pivotal member 30, therefore the pivotal member 30 is restricted by the pair of control plates 50 and is kept in a locked state. Referring to FIG. 4, when the correct symbol-sequence of the padlock is selected, i.e., when the symbol wheels 41 drive the control wheel 42 to be rotated to correct positions, the protrusions 53 of the control plates 50 will respectively align with a corresponding gap 43 of each of the control wheels 42. Since the protrusions 53 are not restricted by the periphery of the control wheel 42 in this position, the downward force applied by the flexible bar 60 will enable the pair of control plates 50 to move downward and be separated from the recess 32 of the pivotal member 30. Referring to FIG. 7, pressing the release member 70 will apply a force to the stopper 33 of the pivotal member 30, thereby enabling the pivotal member 30 to pivot. In this way, the rod 34 will move away from the hook-like latch 11 of the body and remain in an unlocked state. It is to be noted that the angled resilient strip 61 is deformed when the stopper 33 of the pivotal member 30 pivots. As a result, a return force of the resilient strip 61 enables the stopper 33 of the pivotal member 30 to be returned to its initial position (see FIG. 6) when the release member 70 is released. At this time, resetting the number sequence of the symbol-sequence selecting member 40 enables each control plate 50 to be stopped by the periphery of the corresponding control wheel 42 again, whereby each control plate 50 returns to be received in the recess 32 of the pivotal member 30 and the padlock will be in the locked state again. It is appreciated that the padlock with the above mentioned construction is able to be easily operated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A padlock comprising:

a body composed of a first casing and a second casing, said first casing having a hook-like latch integrally extending therefrom and defining a through hole therein and a plurality of notches at two sides thereof, said second casing defining a plurality of apertures therein and said first casing having a plurality of posts integrally extending from an inner face thereof, said plurality of posts being respectively inserted through said plurality of apertures to engage the first casing with the second casing, said second casing including a longitudinal trough defined in an inner face thereof, a knob formed in the longitudinal trough, a pair of shaft supports respectively extending from the inner face thereof; and a clip formed on the inner face and near a top end thereof;

a pivotal member received in the body, said pivotal member having a rod extending from a first end thereof to alignedly contact the hook-like latch when it is pivoted;

a symbol-sequence selecting means received in the body and operatively coupled to the pivotal member for symbol selection, a part of said symbol-sequence selecting means projecting from the notches of the body to be operated by a user; and a release member movably received in the through hole of the body to activate pivoting of the pivotal member.

2. A padlock as claimed in claim 1, wherein said pivotal member has a transverse spindle, said rod integrally and perpendicularly extending from one end of the transverse spindle, said transverse spindle defining an axial recess in a periphery thereof and having a stopper extending from an intermediate peripheral portion thereof.

3. A padlock as claimed in claim 2, wherein said symbol-sequence selecting means includes a plurality of wheel means symmetrically arranged adjacent to two sides of the padlock, each wheel means having a symbol wheel, a corresponding control wheel and a spring mounted around a respective boss extending from the first casing, each of said symbol wheels being partly exposed from a corresponding notch of the first casing, each of said control wheels defining a gap in a periphery thereof.

4. A padlock as claimed in claim 3, further comprising a pair of control plates respectively engagingly received in the recess of the pivotal member and cooperated with a pair of wheel means of the symbol-sequence selecting means, each control plate defining an elliptical hole for movably receiving a control wheel of one of the plurality of wheel means and an arcuate cutout at a bottom end thereof for movably receiving a control wheel of an alternative one of the plurality of wheel means, each control plate further having a protrusion integrally extending from a periphery defining each of the elliptical hole and the arcuate cutout to correspond to the gap defined in each control wheel.

5. A padlock as claimed in claim 4, further comprising a flexible bar grippingly received in the clip of the second casing, said resilient bar having two ends respectively abutting against a top face of each control plate and applying a downward force to the control plates.

6. A padlock as claimed in claim wherein said release member is configured as an arcuate plate body and has a pivot integrally formed at a lower portion thereof to be secured in the pair of shaft supports and a flange integrally extending from a periphery thereof to abut against a periphery defining the through hole for preventing separation of the release member from the through hole.

7. A padlock as claimed in claim 2, wherein said release member further includes an arcuate press portion integrally extending inward from a top end of the arcuate plate body to abut against a first side of the stopper of the pivotal member.

8. A padlock as claimed in claims further comprising an angled resilient strip arranged in the body thereof, said angled resilient strip having a top end abutting a second side of the stopper of the pivotal member, and a bottom end with a locating hole engaged with the knob of the trough of the second casing.

* * * * *